United States Patent [19]

Friesen et al.

[11] 4,397,590

[45] Aug. 9, 1983

[54] METHOD AND APPARATUS FOR COMPACTING BACKFILL IN TRENCHES

[76] Inventors: Orlando H. Friesen, 7243 West Titan Rd., Littleton, Colo. 80125; John J. Fink, 8950 Clay St., Denver, Colo. 80221

[21] Appl. No.: 259,476

[22] Filed: May 1, 1981

[51] Int. Cl.[3] ..... E02D 3/02

[52] U.S. Cl. ..... 405/271; 405/154; 405/269

[58] Field of Search ..... 405/271, 163, 182, 159; 404/115, 116; 175/21, 55, 56

[56] References Cited

U.S. PATENT DOCUMENTS

| | | | |
|---|---|---|---|
| 2,334,228 | 11/1943 | Steuerman | 405/271 |
| 2,488,915 | 11/1949 | Jackson | 405/271 X |
| 2,718,761 | 9/1955 | Steuerman | 405/271 |
| 2,755,632 | 7/1956 | Hauber | 405/163 |
| 3,130,552 | 4/1964 | Bodine | 405/271 X |
| 4,112,692 | 9/1978 | Anderson | 405/271 |
| 4,126,007 | 11/1978 | Mars | 405/271 |
| 4,154,551 | 5/1979 | Petrie | 405/163 X |
| 4,280,770 | 7/1981 | Woodruff | 405/271 X |

*Primary Examiner*—Nile C. Byers, Jr.
*Attorney, Agent, or Firm*—Edwin L. Spangler, Jr.

[57] ABSTRACT

This invention relates to a backfill compaction apparatus of a type particularly well suited to the puddling and compaction of loose soil around pipes laid in trenches, such apparatus being characterized by a self-propelled carriage adapted to straddle the pipe and advance therealong incrementally, a mast supported in upstanding relation on the front end of the carriage, a forwardly-extending boom mounted on the mast for vertical movement relative thereto, means operatively interconnecting the mast and boom for raising and lowering the latter, a tool-carrying platform suspended from the boom in overhanging relation to the trench to be backfilled, at least one pair of transversely-spaced combination puddling and vibrating subassemblies hanging from the tool-carrying platform adapted to enter the trench on opposite sides of a pipe laid therein, said subassemblies each including an elongate rigid nozzle for introducing water beneath the surface of the backfill and a vibrator connected to said nozzle for movement therewith, means for introducing water into said nozzles connectable to a remote pressurized source thereof, and a self-contained hydraulic system on board the carriage for powering the vibrators. The invention also encompasses the novel method of compacting backfill which comprises digging a hole into the backfill with a jet of water under pressure while simultaneously vibrating the surrounding loose soil until it caves into the puddle of water at the bottom of the hole thus produced.

6 Claims, 7 Drawing Figures

METHOD AND APPARATUS FOR COMPACTING BACKFILL IN TRENCHES

The backfilling of trenches and the compaction of the backfill so as to eliminate pockets and voids which, sooner or later, will cave in and result in sunken areas on the surface have long been a problem. The usual solution involves a good deal of hard manual labor in which the backfill is first "puddled" with water and then compacted in some fashion, usually by means of compressed air-powered compactors of the hand-held type which are literally bounced around over the surface with the purpose in mind of eliminating the greater part of the subsurface voids.

In deep trenches, the aforementioned backfilling procedures are only effective if performed repeatedly as each fresh layer of backfill is laid down; otherwise, the earth above the void absorbs the energy with the result that at least a significant portion of the pockets that exist remain untouched. Moreover, these manual backfilling operations are highly labor-intensive in addition to being extremely slow. One factor that adds significantly to the cost burden of such an operation is the necessity for shoring the walls of the trench to protect the laborers working therein.

One particular backfilling operation that is especially critical is that of compacting the backfill alongside and, most importantly, beneath a pipeline or other buried conduit. A trench with nothing in it that settles and caves in is usually not too serious a problem because one need only repair the surface damage. On the other hand, a cave-in of a pipeline trench can result in serious and even dangerous subsurface problems if a break or rupture in the line occurs due to weight of the earth thereabove and the lack of support therebeneath. Also, the conventional compaction techniques using reciprocating hammers of one type or another are virtually useless as far as compacting the soil in the most critical area of all, namely, directly underneath the pipe.

Applicants are not the first to try and solve this soil compaction problem. Some persons in the past like Jackson (U.S. Pat. No. 2,488,915) have used a dragline hung from the boom of a crane to haul a vibrator suspended therefrom to and fro over the freshly deposited backfill. The puddling, if any, that took place while using Jackson's vibrator was, evidently, independent of his compaction operation. A somewhat contrary compaction philosophy is found in the U.S. patents to Klinck (U.S. Pat. No. 1,623,843) and de Larosiere de Champfeu (U.S. Pat. No. 4,075,853) both of which teach the puddling of the uncompacted soil without vibrating it.

Among those machines which impart vibratory motion but include no provision for puddling are those of Dale (U.S. Pat. No. 3,753,621), Cooper et al (U.S. Pat. No. 4,128,359), and Mall (U.S. Pat. No. 2,148,214). As a matter of fact, these patents all relate to concrete vibrators as opposed to soil compaction devices. Concrete, of course, requires a carefully controlled mix of cement and water which precludes indiscriminate puddling. Moreover, the vibratory action has a different function and result, namely, that of causing the thixotropic mixture (concrete) to flow. Soil is not a thixotropic substance and, therefore, the techniques employed to compact it are quite different. The concrete vibrating machines shown in these patents would be unsuitable for compacting soil because, as will be explained presently, it is of utmost importance in applicants' apparatus that a high pressure jet of water be used to drive the hole into which the vibrator attached thereto follows. Also, on the lifting stroke, the water jet must puddle the cavity thus produced while the vibrator loosens the soil surrounding same to a point where it caves in and fills the hole as the subassembly retracts. The main significance of these patents as prior art lies in the fact that they all straddle the working surface, are capable of being advanced therealong and they include a plurality of vibratory devices hung from a frame that can be adjusted to vary their position in relation to the working surface.

The only self-propelled apparatus for backfilling a trench known to applicants is that which forms the subject matter of U.S. Pat. No. 3,596,384. It, however, has as its primary function that of collecting the soil from the ditchback and returning it to the ditch. No vibratory action seems to be used and, instead, the screened soil is propelled or flung into the ditch by means of powered impellers.

Steverman's U.S. Pat. Nos. 2,667,749 and 2,718,761 both combine puddling and vibrating functions into a single tool. The design and method of using this combination tool is, however, quite different from that of applicants' apparatus in that the water jet is not employed to dig the hole into which the vibrator follows. Instead, projections on the side of the tool slice into the sides of a conical hole and upwardly directed jets of water cause the soil to cave in and fill the slices thus created.

It has now been found in accordance with the teaching of the instant invention that a very effective method of compacting backfill in a trench, particularly one containing a pipe, involves simultaneously puddling and vibrating the unsettled soil using a downwardly-directed jet of water capable of boring its way therethrough. As the means for introducing the jet of water into the unsettled backfill is retracted, it leaves a hole filling with water, the soil alongside of which is saturated and caused to cave in by the accompanying vibratory action imparted thereto. The net result is a highly compacted backfill some 95 to 100% free of voids. From an apparatus standpoint, it is essential that the vibrator and the nozzle that cooperate to puddle and compact the backfill in accordance with the previously described method are physically associated with one another at all times such that the water jet drives the hole within which the vibrator vibrates on the downstroke and the vibrator, in turn, vibrates the saturated soil wetted by the water jet and causes it to cave in and fill the hole left by the assembly as it retreats during the upstroke. The foregoing method and apparatus have proven to be very effective in even compacting the soil beneath a pipeline which has, heretofore, been very difficult to do by existing methods including manual pick and shovel work. The compactor subassemblies consisting of the associated nozzle and vibrator which cooperate in the manner just described are mounted upon a unique self-propelled carriage that straddles the pipe and rides the ditch bank. A single operator rides the carriage controlling the progress thereof and also positioning and repositioning the compactor subassemblies as the backfill is returned to the trench. A tiltable mast mounts an overhanging boom which, in turn, suspends in essentially free-hanging relation a transversely-extending tool-carrying platform. The resulting assembly allows the operator to raise and lower the compactors, swing them out of the way into a stowed position, move them to and fro relative to the carriage and otherwise place them wherever he or she wishes within the trench. The carriage carries its own hydraulic pump, hydraulic fluid supply, cooling system for cooling the hydraulic fluid and means for getting the water on board from the ditch bank and into the nozzles. While rigid nozzles are used, they are pivotally suspended from the tool platform so that they can work underneath the pipe and carry the vibrators along.

It is, therefore, the principal object of the present invention to provide a novel and improved method and apparatus for compacting backfill in a trench.

A second object is to provide a method and apparatus of the character described which is particularly well suited to compacting soil around a pipe laid in the bottom of a trench.

Another objective of the within described invention is the provision of a self-propelled soil compaction apparatus that rides the ditchbank or freshly-compacted areas in straddling relation to a pipe laid in the bottom thereof and supports two or more compactor subassemblies for movement along both sides thereof, up and down and therebeneath.

Still another object is to provide a backfill compaction apparatus wherein the compaction tools are suspended in substantially free-hanging relation from a platform therefor that can be raised and lowered as well as shifted to and fro to a limited degree as required.

An additional object is to provide a rigid compactor subassembly containing both a nozzle and vibrator connected together in side-by-side relation that will maintain its direction of movement into the unsettled soil without wandering while, at the same time, digging its own hole with a jet of water issuing from the nozzle.

Further objects are to provide a backfill compactor that is rugged, versatile and easy to operate as well as one which results in considerable savings in both time and labor while, at the same time, remaining over 95% effective in carrying out its assigned task.

Other objects will be in part apparent and in part pointed out specifically hereinafter in connection with the description of the drawings which follows, and in which.

Figure 1:
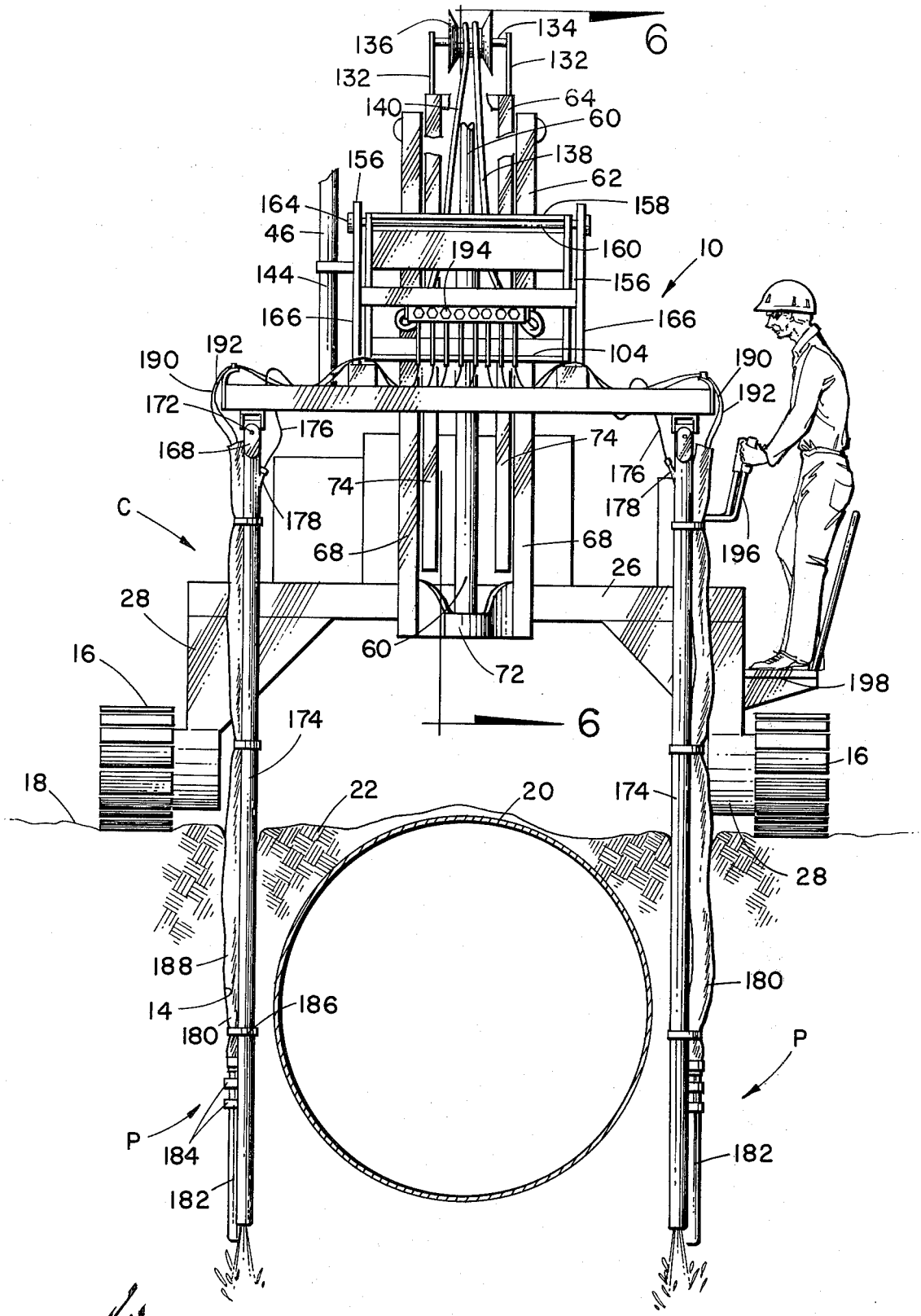
FIG. 1 is a front elevation, portions of which are in section, showing the compaction apparatus in the process of compacting the backfill around a large diameter pipe laid in a trench.
Figure 2:
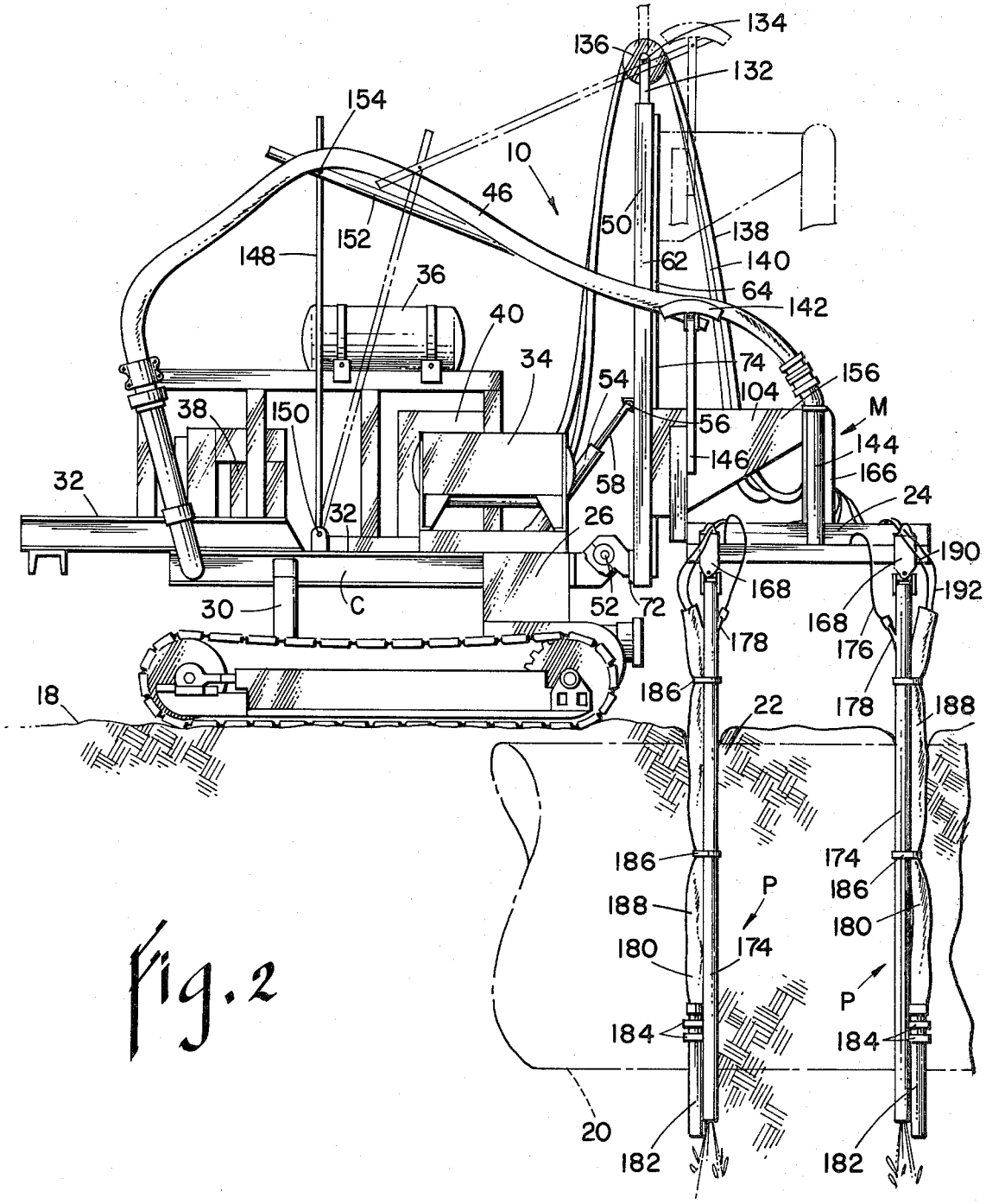
FIG. 2 is a side elevation of the apparatus of FIG. 1 to just a slightly smaller scale.

Referring initially to FIGS. 1 and 2, it can be seen that the compaction apparatus has been indicated in a general way by reference numeral 10. A self-propelled carriage C straddles the ditch or trench 14 with its traction means 16 for advancing same riding along the ditchbank 18 or over the freshly-compacted areas. In the particular form illustrated, a large diameter pipe or conduit 20 is shown laid in the bottom of the trench with backfilled soil 22 placed therearound. Mounted on the front end of the carriage C is what will be referred to here as a "mast assembly" for lack of a more appropriate term that has been broadly designated by the letter M. Hanging from the tool-carrying platform 24 of this mast assembly are the individual combination vibrating and puddling subassemblies that have been indicated broadly by reference letter P.

Starting with the carriage C, it will be seen in FIG. 1 to include an inverted generally U-shaped bridge-like frame 26 of a width adapted to straddle the largest of the pipes 20 likely to be encountered in service. The ends 28 of frame 26 mount the traction means 16 which, in the particular form shown, comprise caterpillar tracks. While wheels can be substituted for the tracks shown, the latter have the advantage of providing a large supporting surface ideally suited to supporting the rather heavy apparatus therebetween in soft newly compacted soil. This is especially true when the size of the trench is such that the tracks must ride along the freshly backfilled areas alongside the pipe in contrast to the ditchbank 18 which may consist of largely undisturbed soil. The track mechanisms shown are commonplace in the art and are customarily driven by hydraulic motors (not shown) powered by the same hydraulic system that is used to operate the mast assembly M along with various other components as will be explained presently.

Transversely-extending struts 30 (FIG. 2) spaced to the rear of bridge frame 26 also connect onto the traction means in straddling relation to the pipe while cooperating with the bridge frame to support bed 32 atop which are mounted tanks 34 and 36, the gasoline engine 38, the hydraulic fluid pump 40 powered by the latter and such commonplace elements (not shown) as the radiator for cooling the hydraulic fluid. None of these elements is novel and their sole function is that of supplying power to the hydraulic system and to the traction means 16 by means of which the carriage is advanced along the trench. Thus, while certain of these elements are generally identifiable on the carriage C in FIG. 2, no attempt has been made to show them in detail or even describe their specific functions, all this being a matter of common knowledge to those skilled in the art.

On the other hand, brief mention should, perhaps, be made of the operator's platform 42 seen on the left side of the carriage in FIG. 1 just above the left track. The operator stands on this platform and operates the controls 44 which govern the movement of the carriage C as well as those of the mast assembly M. His or her position is such that the location of the compactor subassemblies P relative to the pipe and to one another are clearly visible and can be governed accordingly.

In FIGS. 1–4, the water supply line 46 is clearly visible by means of which water is piped under pressure from a source (not shown) on the ditchbank. The quantity of water required for adequate puddling of the freshly deposited backfill 22 makes it impractical to carry the water in tanks or other receptacles aboard the carriage, tanks 34 and 36 being used for the hydraulic fluid. The water taken on board is eventually distributed to each of the compactor subassemblies P by suitable manifolds 48 carried on the tool-carrying platform 24. The prime function, therefore, of carriage C is that of carrying the operator, mast assembly M and compactor subassemblies P together with the hydraulic system powering the latter along the trench 14 while the backfill is returned thereto from the ditchbank using other equipment (not shown) that forms no part of the present invention. In the case of large trenches, the backfill is customarily bulldozed back into place a layer at a time although, conceivably, shallow trenches could be backfilled and compacted in a single pass.

Figure 3:
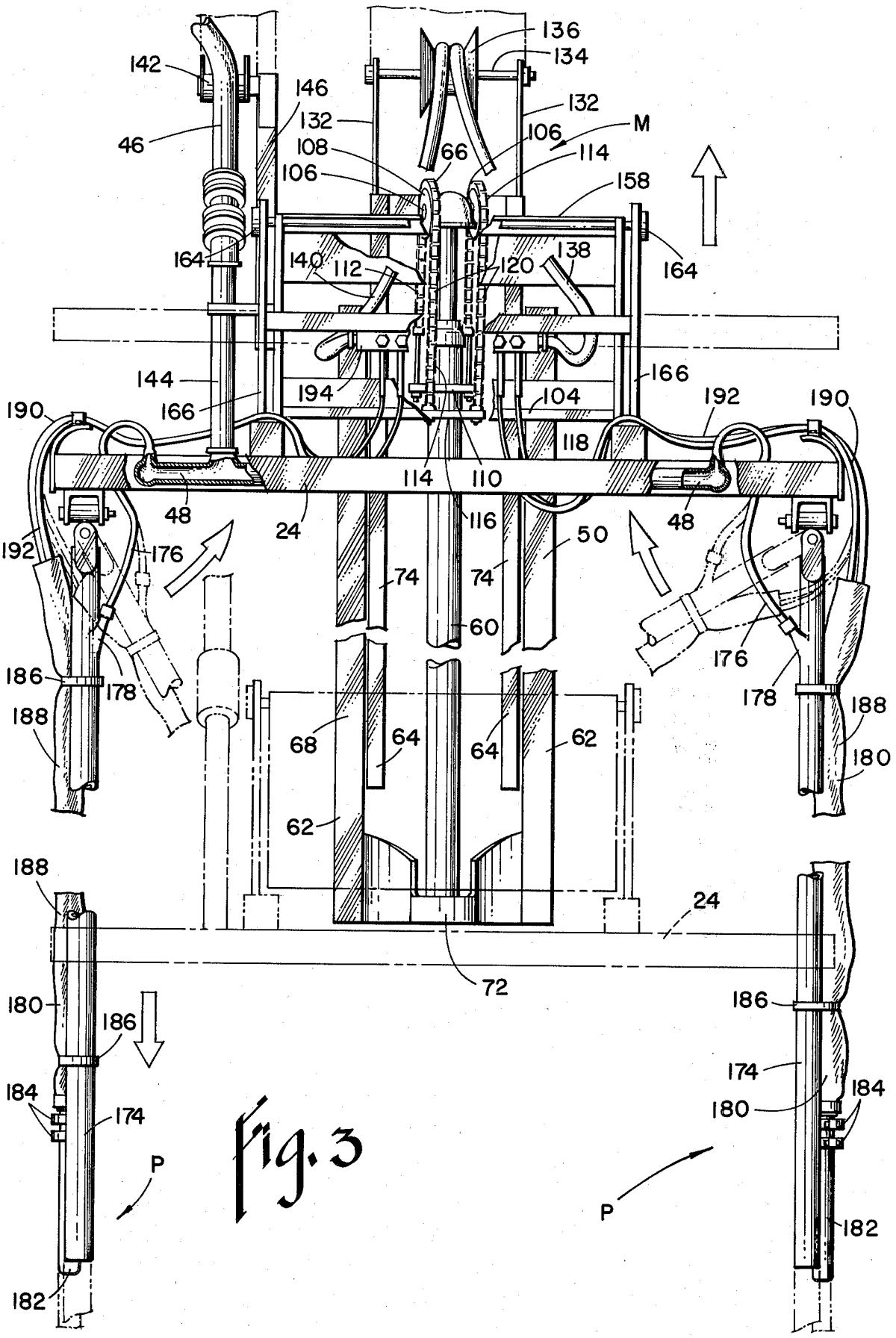
FIG. 3 is a front elevation similar to FIG. 1, but to a much larger scale, showing the tiltable mast, vertically-adjustable boom, tool-carrying platform and compactor subassemblies suspended from the latter, portions of the structure having been broken away and shown in section to both conserve space and better reveal the interior construction.
Figure 4:
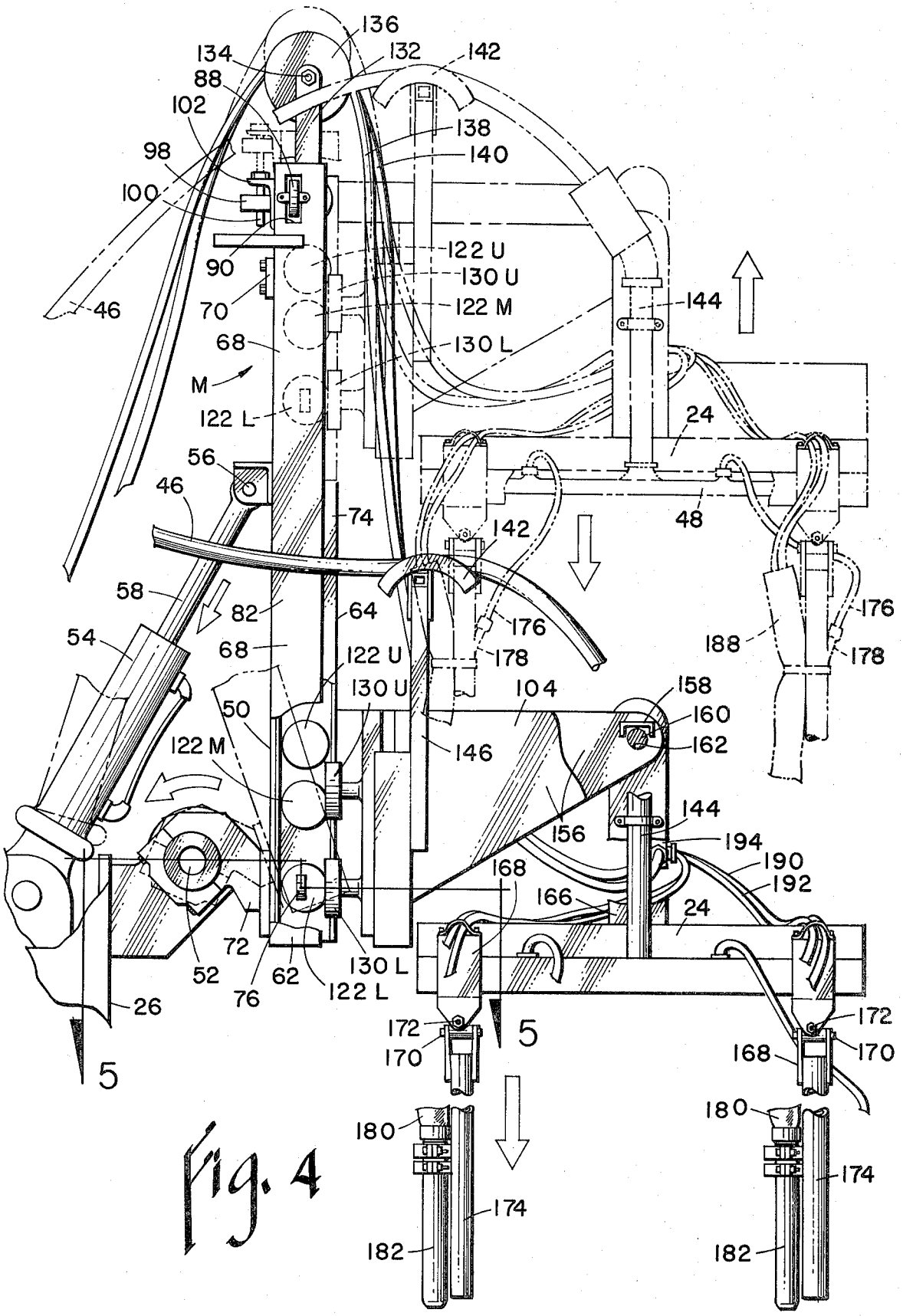
FIG. 4 is a fragmentary side elevation similar to FIG. 2, but to a scale approximating that of FIG. 3 showing further details of the mast assembly and associated structure, portions thereof having been broken away to both conserve space and more clearly reveal the interior construction.

The mast assembly M is most clearly revealed in FIGS. 3–6 to which detailed reference will be made. An upright mast 50 is pivotally attached at its lower end for limited tiltable movement about a transversely-extending horizontal axis 52 in front of the bridge frame 26. A double-acting hydraulic servomotor 54 is connected as shown in FIGS. 4 and 6 between the bridge frame and the mast at a pivot point 56 on the latter spaced well above pivot 52. Upon actuation of servomotor 54 in a direction to retract piston rod 58 as indicated by the arrow in FIG. 4, the mast 50 will tilt rearwardly from its full line into the phantom line position. By so doing, the mast assembly is laid back out of the way for transport to another job site or the like. Conversely, upon extension of piston rod 58, the mast 50 tilts forwardly and places the compactor subassemblies P in their operative positions shown in FIGS. 1, 2 and 7.

Mast 50 telescopes between an extended and a retracted position, the retracted one having been most clearly revealed by full lines in FIGS. 2 and 4 and phantom lines in FIG. 6. The extended position, on the other hand, is shown in full lines in FIG. 6, the full line positions of FIGS. 1 and 3 being intermediate ones. A hydraulic servomotor 60 pivotally connected at its lower end to the fixed frame 62 of the telescoping mast 50 and at its upper end to the movable section 64 thereof, functions to extend and retract the mast while, at the same time, raising and lowering tool-carrying platform 24 twice the distance the mast extends due to a simple 2:1 mechanical advantage achieved through the use of chain and sprocket subassembly 66, the details of which will be set forth presently.

Figure 5:
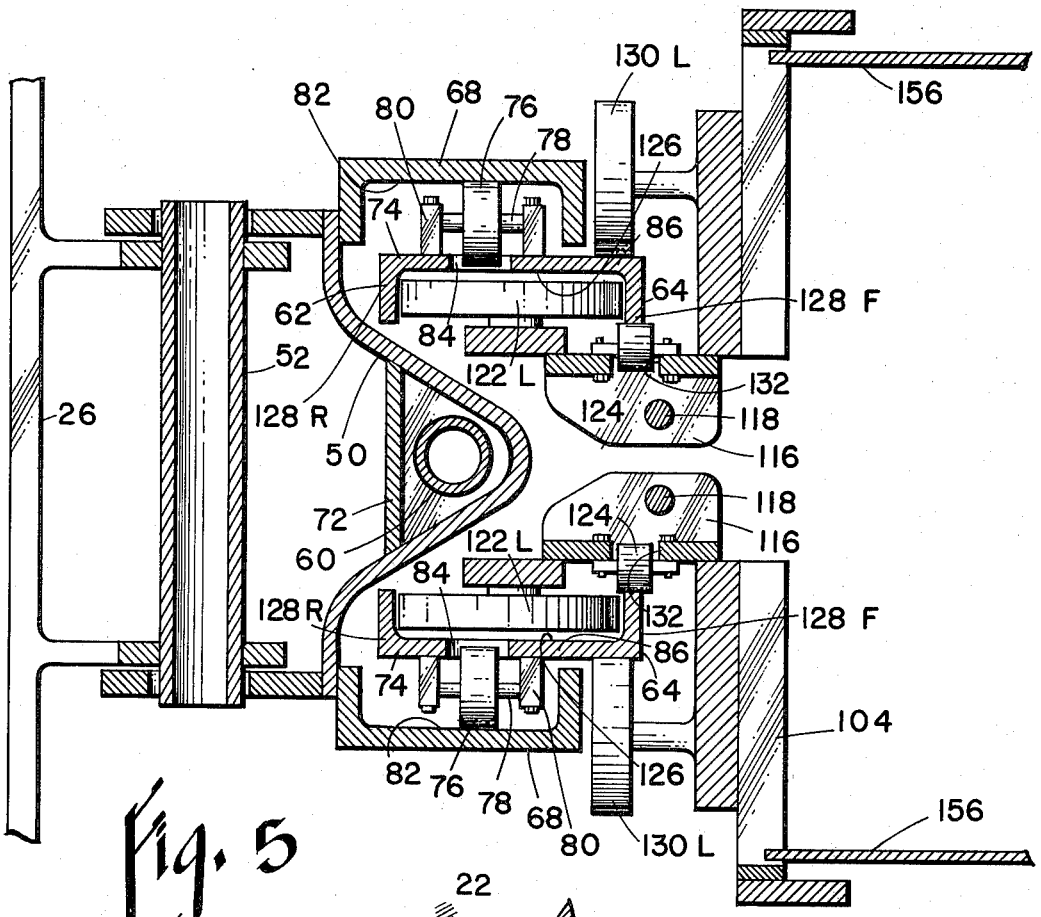
FIG. 5 is a still further enlarged section taken along line 5—5 of FIG. 4.
Figure 6:
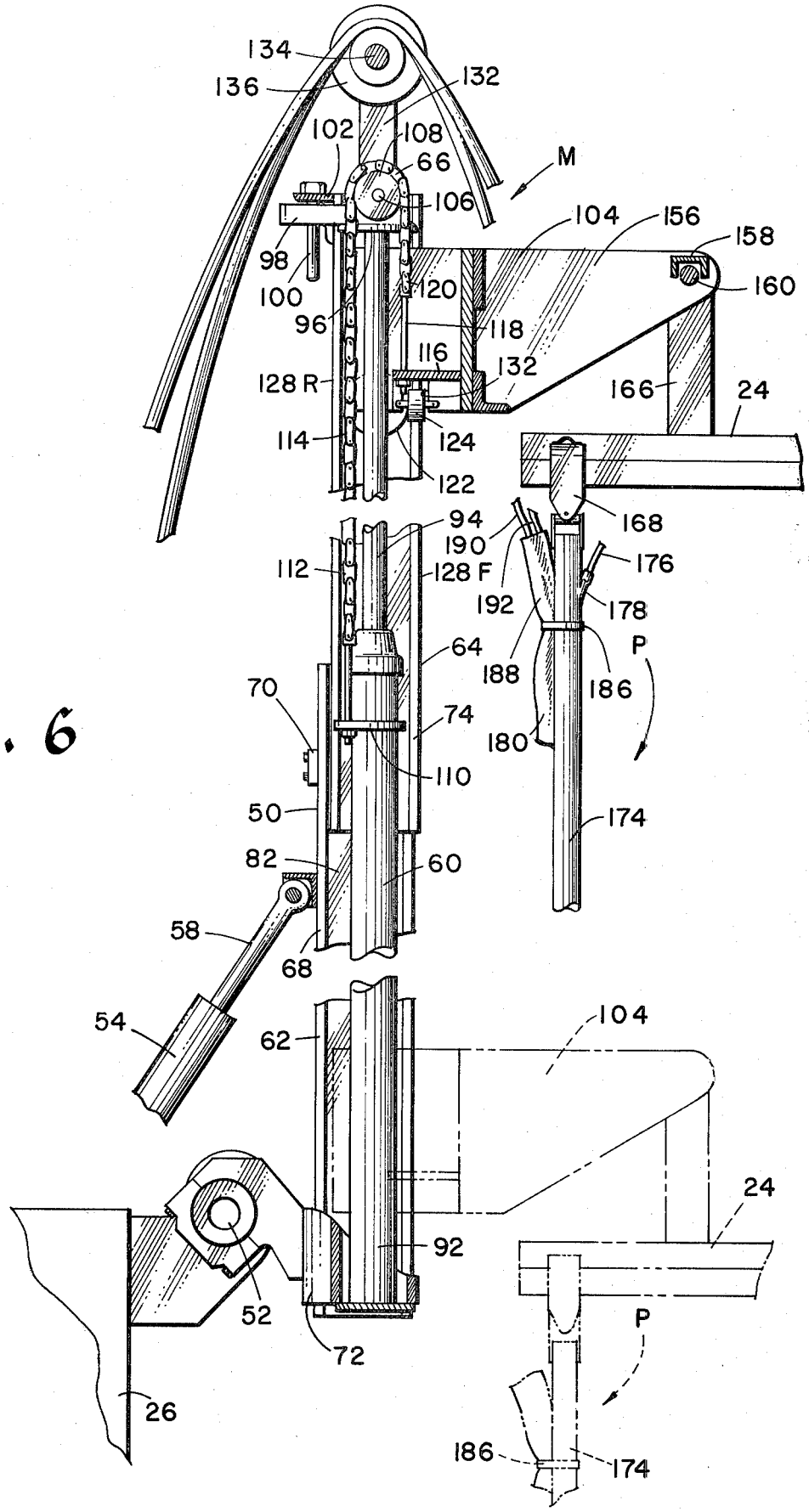
FIG. 6 is a fragmentary section taken along line 6—6 of FIG. 1; and, FIG. 7 is an enlarged fragmentary detail showing how the subassembly consisting of the vibrator and rigid nozzle cooperate to drill a hole through the loose soil using water pressure, puddle it and then cave the soil into the hole thus produced as the assembly is withdrawn.

With particular reference to FIGS. 4, 5 and 6, it can be seen that the fixed frame 62 of the mast 50 includes opposed channels 68 which cooperate with one another in fixed spaced parallel relation maintained by crossframe members 70 and 72 to define outer tracks within which the inner channels 74 of the movable frame 62 telescope. A pair of movable rollers 76 journalled for rotation on transversely-spaced parallel shafts 78 carried by brackets 80 on the outside of inner track-forming channels 74 ride up and down along the webs 82 of channels 68 as shown most clearly in FIG. 5. Dimensional considerations require that apertures 84 be provided in the webs 86 of the inner channels 74 to receive the inside edges of these rollers.

A pair of fixed rollers 88 (FIG. 4) journalled for rotation within apertures 90 in the webs 82 of the fixed frame channels 68 contact the webs 86 of the inner channels 74 as movable frame 64 rides up and down within the fixed frame 62 powered by servomotor 60. The bottom end of the cylinder 92 of motor 60 is secured to crosspiece 72 (FIG. 6) while the upper end of the piston rod 94 is received within inverted cup 96 seen in FIG. 3. Projecting rearwardly from the back of the cup is an apertured ear 98 that receives guide pin 100 which projects beneath crossframe element 102 extending transversely between the channels 74 of the movable frame 62. Actuation of servomotor 60 in a direction to extend piston rod 94 raises cup 96 and the ear 98 depending therefrom up pin 100 until the latter contacts the underside of crossframe member 102, whereupon, the movable frame 63 extends upwardly relative to fixed frame 62 within which it rides and is guided.

As the mast 50 extends in the manner just described, it functions to raise overhanging boom 104 along with the tool-carrying platform 24 and the combination vibrating and puddling subassemblies P hanging beneath the latter. Chain and sprocket subassembly 66 brings this about. As seen in FIGS. 3 and 6, inverted cup 96 carries a horizontally-disposed shaft 106 on opposite ends of which are mounted sprockets 108. A collar 110 encircles cylinder 92 of servomotor 60 and is used to secure the standing legs 112 of sprocket chains 114. After passing over sprockets 108, the other ends of these chains are secured to lugs 116 (FIGS. 5 and 6) carried by the boom 104 using suitable connectors 118.

Extension of the mast 50 along with the chain and sprocket subassembly 66 carried by the movable frame 64 of the latter causes the standing legs 112 of the sprocket chains 114 to lengthen at the expense of the active legs 120 thereof which become shorter and, in so doing, raise the boom 104 and elements suspended therebeneath a distance twice as great as that over which the piston rod 94 has traveled. More specifically in connection with FIG. 6, while the sprockets move from the top of the cylinder 92 into the position in which they are shown, boom 104 will have traveled from the phantom line position into the full line position.

Referring again to FIGS. 4 and 5 in particular, it will be seen that the boom 104 is guided during its excursion up and down the channels 74 of the movable frame. Lugs 118 of the boom 104 to which the active legs of the chains are attached also comprise complex mounting brackets carrying, among other things, sets of three rollers 122L, 122M and 122U, all of which ride in the tracks 126 of inner channels 74 defined between the front and rear channels 128R and 128F thereof cooperating with one another to prevent the boom from moving forwardly or rearwardly, tilting about a transverse axis or twisting about a more or less vertical one. Each bracket 118 also mounts a single roller 124 which rides along the free edge of front flange 128F and cooperates with a vertically-spaced pair of rollers 130L and 130U rolling along the web 86 of channel 74 to prevent sidewise movement of the boom and associated elements while, the same time permitting vertical movement up and down the latter in the manner previously described. Inner channels 74 are offset forwardly of the outer channels 68 to leave a portion of inner channel web 86 exposed for rollers 130 to ride upon. Apertures 132 opening onto the front flanges 128F of the inner channels 74 receive the rollers 124 as shown. The several lugs and ears of the weldment that comprises the complex bracket mounting rollers 122, 124 and 130 has not been described in detail because the one shown is merely representative of any one of a number of such brackets, the design and fabrication of which is well within the skill of the ordinary artisan.

In FIGS. 1–4, it will be seen that inner channels 74 include upstanding extensions 132 which carry a transverse shaft 134 upon which is journalled a wide V-grooved sheave 136. The hydraulic fluid supply and return lines 138 and 140 are draped over this sheave which, of course, moves up and down with the movable frame 64 the mast 50 and, in general, takes up the slack in these hoses so that they stay out of the way. Elevatable broom 104 also carries a saddle 142 offset to one side of the mast 50 over which the water supply line 46 is draped just ahead of its connection to the intake 144 into the distribution manifold 48. Accordingly, saddle 142 which is secured to the top of upright 146 and which, in turn, is attached to the boom, rises and falls with the latter to keep the water line 46 out of the way.

With particular reference to FIG. 2, a novel scissor linkage has been shown which functions in cooperation with the vertical excursion of boom 104 to both create and take up slack in the water supply hose 46. Platform 32 of the carriage C mounts an upstanding link 148 for pivotal movement at its lower end about a transverse axis of tiltable movement defined by pivot 150. A forwardly-extending link 152 is pivotally attached at its front end to upright 146 or some other structure movable with the boom 104. The adjacent ends of links 148 and 152 are pivotally interconnected at 154 for scissor-like movement between the acute angular relationship shown in FIG. 2 where the boom has reached the bottom of the mast and the subassemblies P are lowered all the way to the bottom of the backfill and the obtuse angular relationship that results when the boom is elevated to the top of the mast as indicated by phantom lines in FIG. 4. A medial portion of water line 46 is lashed or otherwise detachably secured to the scissor linkage at the pivotal connection 154 for movement therewith in response to raising and lowering of the boom. Obviously, as the linkage moves from the acute angular relationship into the obtuse one, the upright link will eventually tilt forwardly lowering pivot 154 to create the additional slack in the hose 46 necessary to accommodate the increased distance to the elevated boom. Conversely, as the boom goes back down, pivot 154 rises to the position shown in FIG. 2 taking up the slack.

Boom 104 includes a transversely-spaced pair of forwardly-projecting wings 156 bridged by a crosspiece 158, the details of which are most clearly revealed in FIGS. 3 and 4 to which reference will next be made. A rod 160 extends across the gap separating wings 156, through holes 162 (FIG. 4) in the latter and therebeyond where the ends are terminated in caps 164. Between these end caps and the adjacent exterior surfaces of the wings hanging on shaft are a pair of hangers 166 which are free to swing to and fro in transversely-spaced parallel relation to one another. Rigidly connected to the lower ends of these hangers for swinging movement therewith is the tool-carrying platform 24.

Platform 24 is generally rectangular and can be made any width depending upon the diameter of the pipe 20 it must straddle or, perhaps, the width of the trench in which it is to work. A simplified system has been shown in which only four combination vibrating and puddling subassemblies P have been shown suspended from the four corners of the rectangular platform on gimbal-type pivots 168 which, in the well-known manner of such structures, include two axes of pivotal movement (170 and 172) arranged in right angular relation to one another. These pivotal connections (see the phantom line position in FIG. 3) permit essentially universal motion of each of the combination vibrators and puddlers independently of one another.

Hanging from each pivot is a long rigid pipe 174 into which water from manifold 48 is introduced by means of a short length of hose 176 connected between the latter and side-opening connector 178. Water under pressure from a pressurized source on the ditchbank enters the top of each pipe and flows out the open bottom end thereby digging its own hole down through the uncompacted backfill as the boom and tool-carrying platform are lowered by the operator. The rigid nature of these pipes or long nozzles is essential to direct the jets of water to selected locations in the backfill on a systemized basis. It was found, for instance, that flexible hoses in place of the rigid nozzles wandered randomly within the backfill oftentimes moving horizontally and occasionally even returning to the surface. This uncontrolled distribution of the water within the backfilled soil proved to be of little value as far as effecting the essentially complete compaction possible with the rigid ones.

Figure 7:
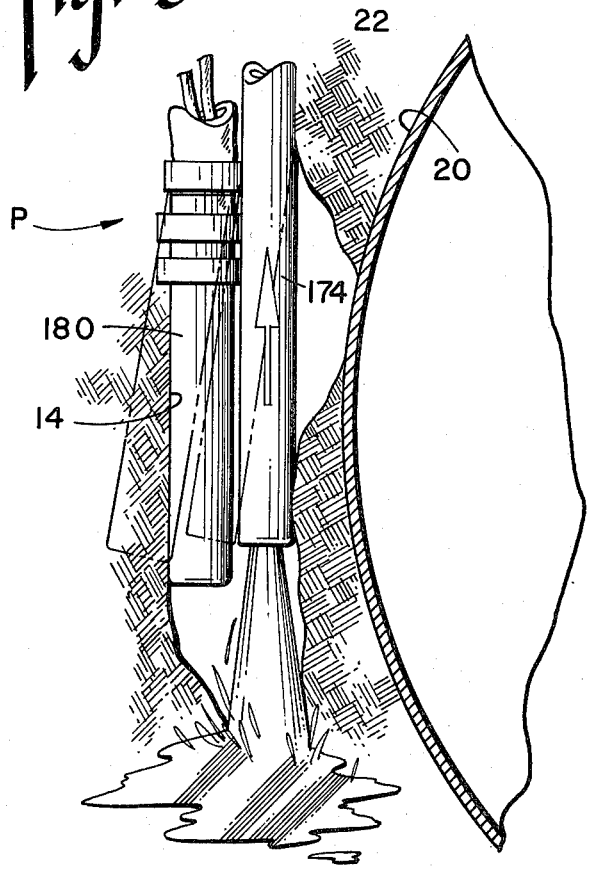

Even more significant is to link the vibrators 180 to these rigid pipes so that they act in concert with one another, the vibrator agitating the loose wet soil bordering the hole drilled by the water jet causing it to cave into the puddle of water at the bottom thereof thus becoming compacted as the subassembly P is withdrawn in the manner shown in FIG. 7. The movement of the subassembly P shown in FIG. 7 is highly exaggerated for purposes of illustration since the actual amplitude of vibration is a small fraction of an inch. On the downstroke of the subassemblies P, the water jet and vibratory action cooperate to loosen and saturate the backfill while digging a hole therein. On the return or lifting stroke, the voids are filled and tests have shown 95% compaction and better.

The carriage C is not moved steadily, but rather, incrementally with a complete cycle of compactor subassembly movement taking place at each stop. As a matter of fact, the compactors may be guided manually, especially tilted toward one another to reach areas under the pipe, to insure complete compaction. As illustrated, no side-to-side movement of the tool-carrying platform relative to the carriage is provided for nor is any required since the vehicle itself can be swung from side-by-side as the occasion demands.

As revealed most clearly in FIGS. 3 and 4, the head 182 of the vibrators is clamped to the pipe by means of clamps 184 so that the former preferably projects a small distance beyond the outlet of the latter. Similar clamps 186 clamp the flexible housing 188 to the pipe as shown. Housing 188 carries the hydraulic fluid supply and return lines 190 and 192 that feed hydraulic fluid to the head 182. These supply and return lines all connect into a manifold 194 which distributes fluid from the main supply line 138 to the individual vibrator supply lines 188 and returns it to the cooler on board the carriage via main return line 140. Between pump 40 and manifold 194 lies the control valves 196 (FIG. 1) accessible from platform 198 where the operator controls movement of the carriage C, the telescoping mast 50 along with the associated movements of the boom 104 and, of course, the action of the combination vibrators and pubblers carried by the latter. No useful purpose would be served by detailing the hydraulic system, the design and operation of which is well within the skill of the ordinary artisan.

What is claimed is:

1. The trench backfill compaction apparatus which comprises:

a self-propelled carriage having transversely-spaced means for advancing same along a trench in straddling relation to a pipe laid therein; an upright mast mounted on the forward end of the carriage; a forwardly-extending boom mounted on the mast for relative movement up and down the latter in overhanging relation to the trench; means connected between a fixed support movable with said carriage and said boom operative upon actuation to raise and lower the latter; a transversely-extending tool-carrying platform suspended from said boom; at least one pair of combination puddling and vibrating subassemblies suspended beneath said tool-carrying platform positioned to enter the trench on opposite sides of a pipe laid therein, said subassemblies each including an elongate rigid nozzle for introducing water beneath the surface of loose soil backfilling the trench and a vibrator connected to said nozzle for coordinated movement therewith; means for introducing water into said nozzles connectable to a remote pressurized source thereof; and, means comprising a self-contained source of power for said vibrators on board the carriage.

2. The compaction apparatus as set forth in claim 1 wherein:

the mast is hingedly attached to the carriage for tiltable movement forwardly and rearwardly relative thereto; and wherein means interconnects said carriage and mast operative upon actuation to effect tiltable movement thereof.

3. The compaction apparatus as set forth in claim 1 wherein:

the mast includes a fixed section and a movable section telescopically received within said fixed section; the boom is secured to the movable section for relative movement up and down the latter; and the means for raising and lowering said boom comprises a first means connected between the fixed and movable sections of said mast operative upon actuation to extend and retract the latter relative to the former and hoisting means connecting the boom to a fixed support movable with the carriage, said hoisting means including pulley-forming means carried by the movable section of the mast and a line reaved from the boom over said pulley-forming means to said fixed support, said boom-actuating means being operative upon actuation of said first means in a direction to extend the movable section of the mast to simultaneously actuate said hoisting means so as to elevate the boom twice the distance said mast section extends.

4. The compaction apparatus as set forth in claim 1 wherein:

the combination puddling and vibrating subassemblies are hingedly suspended from the tool-carrying platform for free-hanging universal movement.

5. The compaction apparatus as set forth in claim 1 wherein:

the tool-carrying platform is hingedly attached to the underside of the boom for side-to-side tiltable movement.

6. The compaction apparatus as set forth in claim 1 wherein:

means comprising a scissor linkage interconnects the carriage with an elevatable element of the apparatus, said linkage supporting the means for carrying water to the nozzles, and said linkage being responsive to movement of said elevatable element by raising and lowering said supply means so as to remove slack therefrom.

* * * * *